US012760729B2

(12) United States Patent
Sheradin

(10) Patent No.: US 12,760,729 B2
(45) Date of Patent: Oct. 13, 2026

(54) ROTARY VANE PUMP WITH ANGULAR POSITION SENSING CAPABILITY

(71) Applicant: Schaeffler Technologies AG & Co. KG, Herzogenaurach (DE)

(72) Inventor: Jacob Sheradin, North Canton, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 160 days.

(21) Appl. No.: 18/797,198

(22) Filed: Aug. 7, 2024

(65) Prior Publication Data

US 2026/0043403 A1 Feb. 12, 2026

(51) Int. Cl.
*F04C 14/28* (2006.01)
*F04C 2/344* (2006.01)

(52) U.S. Cl.
CPC ..... *F04C 14/28* (2013.01); *F04C 2/3441* (2013.01); *F04C 2240/811* (2013.01)

(58) Field of Classification Search
CPC ..... F01C 21/0809; F01C 21/0845; F01C 21/0881; F01C 21/089; F04C 2/344; F04C 2/3441; F04C 2/3442; F04C 14/28; F04C 2240/81; F04C 2240/811; F04C 2270/03–0445; F04C 2270/12–135
See application file for complete search history.

(56) References Cited

U.S. PATENT DOCUMENTS 2,436,876 A * 3/1948 Stamsvik ..... F04C 2/3442 418/258
2,873,725 A * 2/1959 Gilovich ..... F15B 15/12 91/402
2,952,249 A * 9/1960 Conover, Jr. ..... F01C 21/0818 418/152
4,132,512 A * 1/1979 Roberts ..... F01C 21/0845 418/158
4,396,365 A * 8/1983 Hayashi ..... F01C 21/0809 418/179
11,283,342 B1 * 3/2022 Zhao ..... F04D 29/445
2004/0191105 A1 * 9/2004 Maeng ..... F04C 27/002 418/255
2010/0139613 A1 * 6/2010 Pekrul ..... F23C 99/001 123/243
2022/0094255 A1 * 3/2022 Zhao ..... F04D 29/445

* cited by examiner

*Primary Examiner* — Shafiq Mian
(74) *Attorney, Agent, or Firm* — Davidson Kappel LLC

(57) ABSTRACT

A rotary vane pump is provided that includes a rotor configured for being rotated about a center axis and a vane movably positioned in a radially extending slot formed in the rotor. The vane includes a ferrimagnetic material. The pump further includes an actuator positioned in the slot and configured for moving the vane in the slot. The actuator is configured for forcing the vane away from the center axis as the rotor is rotated about the center axis. The pump further includes a variable inductance coil fixed with the rotor and wrapped around the vane. The vane is movable with respect to the variable inductance coil and an inductance of the variable inductance coil is dependent upon an axial position of the ferrimagnetic material with respect to the variable inductance coil.

17 Claims, 2 Drawing Sheets

ROTARY VANE PUMP WITH ANGULAR POSITION SENSING CAPABILITY

The present disclosure relates generally to rotary vane pumps and more specifically to rotary vane pumps with angular position sensing capability.

BACKGROUND

Electric motors can include a shaft driven oil pump and a rotor position sensor, which are two completely separate components having completely different functions.

SUMMARY OF THE INVENTION

A rotary vane pump is provided that includes a rotor configured for being rotated about a center axis and a vane movably positioned in a radially extending slot formed in the rotor. The vane includes a ferrimagnetic material. The pump further includes an actuator positioned in the slot and configured for moving the vane in the slot. The actuator is configured for forcing the vane away from the center axis as the rotor is rotated about the center axis. The pump further includes a variable inductance coil fixed with the rotor and wrapped around the vane. The vane is movable with respect to the variable inductance coil and an inductance of the variable inductance coil is dependent upon an axial position of the ferrimagnetic material with respect to the variable inductance coil.

In examples, the rotary vane pump further includes a measurement unit configured to: receive signals from the variable inductance coil representing the axial position of the ferrimagnetic material with respect to the variable inductance coil; and determine a rotational position of the rotor as a function of the axial position of the ferrimagnetic material with respect to the variable inductance coil.

In examples, the measurement unit includes a data record associating each of the axial positions of the ferrimagnetic material with respect to the variable inductance coil with at least one rotational position of the rotor.

In examples, the measurement unit includes: a first circuit on the rotor configured to receive the signals from the variable inductance coil; a second circuit positioned on a stationary support, the rotor being rotatable with respect to the stationary support; a transmitter on the rotor electrically connected to the first circuit; and a receiver positioned on the stationary support and electrically connected to the second circuit, the transmitter on the rotor configured to transmit the signals from the variable inductance coil to the receiver, the second circuit configured to receive the position signals from the receiver and to determine a rotational position of the rotor as a function of the position of the ferrimagnetic material with respect to the variable inductance coil.

In examples, the rotary vane pump further includes a housing including a fluid inlet and a fluid outlet, the vane configured for a tip of the vane to move along an inner circumferential surface of the housing past the fluid inlet and the fluid outlet as the rotor rotates about the center axis, the actuator configured to force the tip of the vane into the inner circumferential surface of the housing past as the vane rotates about the center axis.

In examples, the inner circumferential surface of the housing has a circular shape when viewed axially, the center axis of the rotor being eccentrically positioned with respect to the circular shape such that the housing and the rotor define a fluid flow chamber having a crescent-shaped cross-section when viewed axially.

In examples, the fluid inlet is at a first end of the crescent-shaped cross-section and the fluid outlet is at a second end of the crescent-shaped cross-section.

In examples, the rotary vane pump further includes a further vane movably positioned in the radially extending slot formed in the rotor, the further vane including a ferrimagnetic material; the actuator positioned in the slot and configured for moving the further vane in the slot, the actuator configured for forcing the further vane away from the center axis as the rotor is rotated about the center axis; and a further variable inductance coil fixed with the rotor and wrapped around the further vane, the further vane being movable with respect to the further variable inductance coil, an inductance of the further variable inductance coil being dependent upon an axial position of the ferrimagnetic material of the further vane with respect to the further variable inductance coil.

In examples, the rotary vane pump further includes a housing surrounding the rotor and configure for defining a fluid flow chamber between the housing and the rotor, the actuator configured for forcing a tip of the vane against the housing in a first radial direction and for forcing a tip of the further vane against the housing in a second radial direction opposite of the first radial direction.

In examples, the actuator is a spring.

A method of constructing a rotary vane pump includes movably positioning a vane in a radially extending slot formed in a rotor. The vane includes a ferrimagnetic material. The method also includes positioning an actuator in the slot such that the actuator is configured for moving the vane in the slot to force the vane away from a center axis of the as the rotor is rotated about the center axis; and fixing a variable inductance coil in the rotor wrapped around the vane. The vane is movable with respect to the variable inductance coil, and an inductance of the variable inductance coil being dependent upon an axial position of the ferrimagnetic material with respect to the variable inductance coil.

In examples, the method further includes providing a housing surrounding the rotor, the housing including a fluid inlet and a fluid outlet, the vane configured for a tip of the vane to move along an inner circumferential surface of the housing past the fluid inlet and the fluid outlet as the rotor rotates about the center axis, the actuator configured to force the tip of the vane into the inner circumferential surface of the housing as the vane rotates about the center axis.

In examples, the inner circumferential surface of the housing has a circular shape when viewed axially, the center axis of the rotor being eccentrically positioned with respect to the circular shape such that the housing and the rotor define a fluid flow chamber having a crescent-shaped cross-section when viewed axially.

In examples the fluid inlet is at a first end of the crescent-shaped cross-section and the fluid outlet is at a second end of the crescent-shaped cross-section.

A method of operating the rotary vane pump includes receiving, by a measurement unit, signals from the variable inductance coil indicating the axial position of the ferrimagnetic material with respect to the variable inductance coil; and determining, by the measurement unit, a rotational position of the rotor as a function of the axial position of the ferrimagnetic material with respect to the variable inductance coil.

In examples, the method further includes, recording, by the measurement unit, a data record associating each of the axial positions of the ferrimagnetic material with respect to the variable inductance coil with at least one rotational position of the rotor.

In examples, the method further includes transmitting, by a transmitter on the rotor, the signals from the variable inductance coil to the receiver; receiving, by a receiver positioned outside of the rotor, the signals; and determining a rotational position of the rotor as a function of the position of the ferrimagnetic material with respect to the variable inductance coil.

BRIEF DESCRIPTION OF THE DRAWINGS

The present disclosure is described below by reference to the following drawings, in which.

DETAILED DESCRIPTION

The present disclosure provides a rotary vane pump constructed with an arbitrary number of vanes made of a sufficient magnetically permeability material. The pump includes a rotor containing coils through which some or all vanes will pass during operation. During normal operation of the pump, the inductance of the coils change relative to the position of the pump rotor. By observing the inductance of the coils, it is possible to know the speed and/or absolute angular position of the pump rotor.

Figure 1:
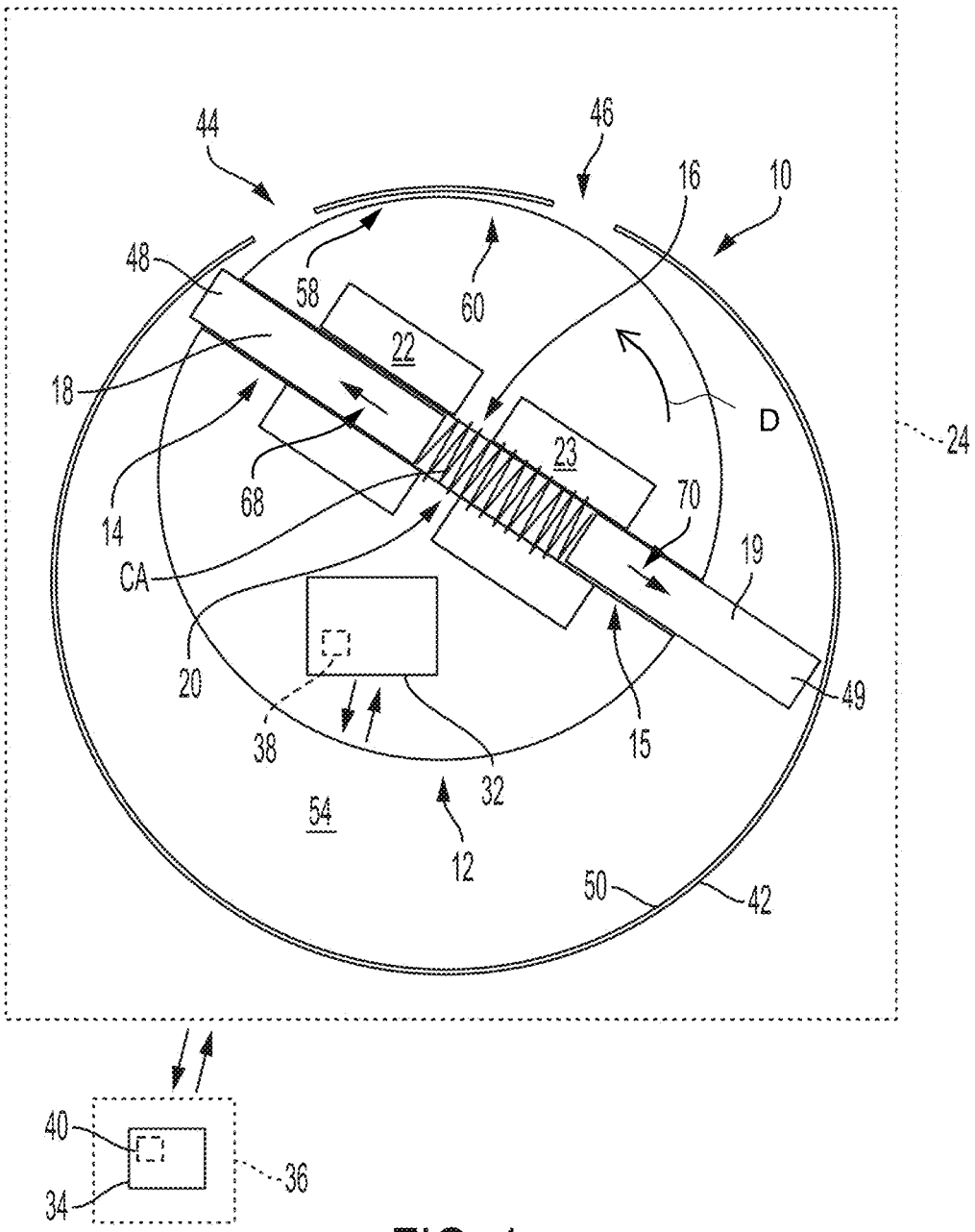
FIG. 1 schematically shows an axially facing cross-sectional view of a rotary vane pump according to the present disclosure.

FIG. 1 schematically shows an axially facing side view of a rotary vane pump 10 comprises a rotor 12 configured for being rotated about a center axis CA in a direction D. The rotary vane pump 10 includes vanes 14, 15 movably positioned in a radially extending slot 16 formed in the rotor 12. Each vane 14, 15 includes a respective ferrimagnetic material 18, 19. Each vane 14, 15 can be formed solely of ferrimagnetic material 18, 19 or can include a coating surrounding the ferrimagnetic material 18, 19. Rotor 12 further includes an actuator in the form of a spring 20 positioned in the slot 16 and configured for moving the vanes 14, 15 in the slot 16. The spring 20 is configured for forcing the vanes 14, 15 away from the center axis CA as the rotor 12 is rotated about the center axis CA. For each vane 14, 15, a variable inductance coil 22, 23 is fixed to the rotor 12 and wrapped around the respective vane 14, 15. Each of the vanes 14, 15 is movable with respect to the respective variable inductance coil 22, 23 and an inductance of the variable inductance coil 22 is dependent upon an axial position of the ferrimagnetic material 18, 19 with respect to the respective variable inductance coil 22, 23. Rotor 12 is a rotor of a schematically shown electric motor 24.

As described further below with respect to FIG. 2, the rotary vane pump 10 further comprises a measurement unit 26 configured to receive signals from the variable inductance coils 22, 23 representing the axial positions of the ferrimagnetic material 18, 19 with respect to the respective variable inductance coil 22, 23. The measurement unit 26 determines a rotational position of the rotor 12 as a function of the axial positions of the ferrimagnetic material 18, 19 with respect to the respective variable inductance coil 22, 23. The rotational position of the rotor 12 can then be used for controlling the electric motor 24.

The measurement unit 26 includes a data record 30 associating each of the axial positions of the ferrimagnetic material 18, 19 with respect to the respective variable inductance coil 22, 23 with at least one rotational position of the rotor 12. The measurement unit 26 also includes a first circuit 32 on the rotor 12 configured to receive the signals from the variable inductance coils 22, 23, and a second circuit 34 positioned on a stationary support 36. The rotor 12 is rotatable with respect to the stationary support 36. The measurement unit 26 also includes transmitter 38 on the rotor 12 electrically connected to the first circuit 32, and a receiver 40 positioned on the stationary support 36 and electrically connected to the second circuit 34. The transmitter 38 on the rotor 12 is configured to transmit the signals from the variable inductance coil 22 to the receiver 40. The second circuit 34 is configured to receive the position signals from the receiver 40 and to determine a rotational position of the rotor 12 as a function of the position of the ferrimagnetic material 18, 19 with respect to the respective variable inductance coil 22, 23.

The rotary vane pump 10 further comprises a housing 42 surrounding the rotor 12 and configured for defining a fluid flow chamber 54 between the housing 42 and the rotor 12. The housing 42 includes a fluid inlet 44 and a fluid outlet 46. Each vane 14, 15 includes a respective tip 48, 49 and vanes 14, 15 are configured for tips 48, 49 to move in the fluid flow chamber 54 along an inner circumferential surface 50 of the housing 42 past the fluid inlet 44 and the fluid outlet 46 as the rotor 12 rotates about the center axis CA. The spring 20 is configured to force the tips 48, 49 of the vanes 14, 15 into the inner circumferential surface 50 of the housing 42 as the vanes 14, 15 rotate about the center axis CA. More specifically, the spring 20 is configured for forcing the tip 48 of vane 14 against the housing 42 in a first radial direction 68 and for forcing the tip 49 of the vane 15 against the housing 42 in a second radial direction 70 opposite of the first radial direction 68.

The inner circumferential surface 50 of the housing 42 has a circular shape when viewed axially, as in FIG. 1. The center axis CA of the rotor 12 is eccentrically positioned with respect to the circular shape such that the housing 42 and the rotor 12 define a fluid flow chamber 54 having a crescent-shaped cross-section when viewed axially. The fluid inlet 44 is at a first end 58 of the crescent-shaped cross-section, and the fluid outlet 46 is at a second end 60 of the crescent-shaped cross-section.

Figure 2:
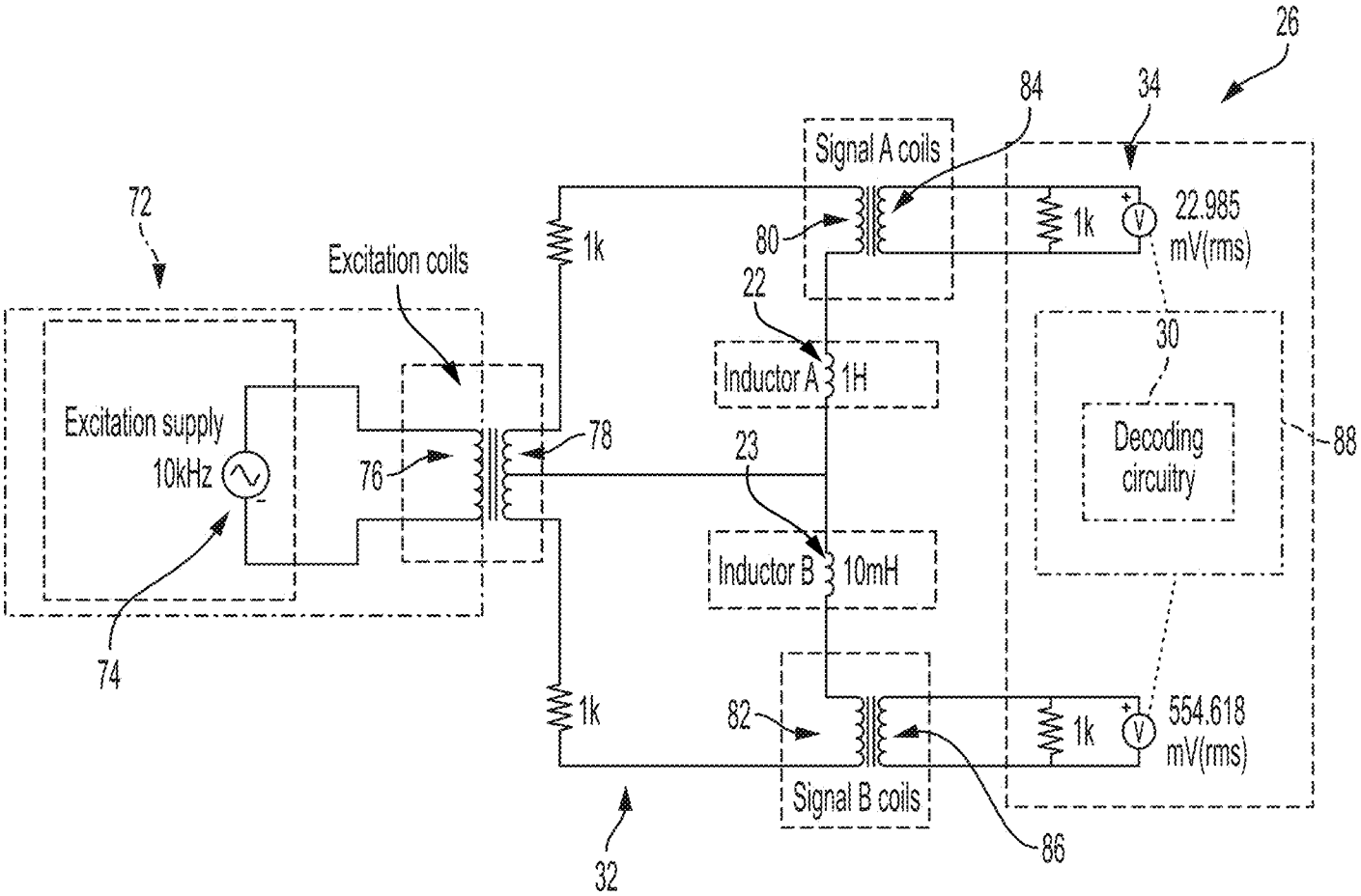
FIG. 2 schematically shows a measurement unit of the rotary vane pump according to the present disclosure.

FIG. 2 shows an embodiment of the measurement unit 26 configured for measuring the inductance of the coils 22, 23 and transmitting the signals representative of the inductance to the secondary circuit 34 of the assembly. Circuits 32, 34 can be directly connected via a slip ring or brush connection or wirelessly. The circuit 32 onboard the rotor 12 measures inductance and transmits it wirelessly or via the slip ring or brush connection to the secondary circuitry 34.

The measurement unit 26 shown in FIG. 2 is a variable transformation ratio circuit. The measurement unit 26 is wirelessly powered via a power source 72 connected to the stationary support 36. The power source 72 includes an excitation supply 74, and a transmit coil 76 for transmitting power from the excitation supply 74 to a receive coil 78 of circuit 32 that is onboard the rotor 12.

The transmitter 38 is formed by a first transmit coil 80 electrically connected to the variable inductance coil 22 and a second transmit coil 82 electrically connected to the variable inductance coil 23. Transmit coils 80, 82 wirelessly transmit the signals from variable inductance coil 22, 23 to the stationary receiver 40, which is formed by a first receiver coil 84 in wireless communication with transmit coil 80 and a second receiver coil 86 in wireless communication with transmit coil 82. The second circuit 34 includes decoding circuitry and a microprocessor 88 that includes the data record 30.

The waveform of the signals received by the second circuit 34 is directly related to the inductance of inductors 22, 23 thereby providing position information about the rotor.

A method of constructing the rotary vane pump 10 comprises movably positioning the vanes 14, 15 in the radially extending slot 16 formed in the rotor 12, and positioning the spring 20 in the slot 16 such that the spring 20 is configured for moving the vanes 14, 15 in the slot 16 to force the vanes 14, 15 away from a center axis CA as the rotor 12 is rotated about the center axis CA. The method further includes fixing the variable inductance coils 22, 23 in the rotor 12 wrapped around the respective vane 14, 15.

A method of operating the rotary vane pump 10 comprises receiving, by the measurement unit 26, signals from the variable inductance coil 22 indicating the axial position of the ferrimagnetic material 18 with respect to the variable inductance coil 22. Determining, by the measurement unit 26, the rotational position of the rotor 12 as the function of the axial position of the ferrimagnetic material 18 with respect to the variable inductance coil 22.

The method further comprises recording, by the measurement unit 26, the data record 30 associating each of the axial positions 24 of the ferrimagnetic material 18 with respect to the variable inductance coil 22 with at least one rotational position of the rotor 12.

The method further includes transmitting, by the transmitter 38 on the rotor 12, the signals from the variable inductance coil 22 to the receiver 40, receiving, by the receiver 40 positioned outside of the rotor 12, the signals, and determining the rotational position of the rotor 12 as the function of the position of the ferrimagnetic material 18 with respect to the variable inductance coil 22.

In the preceding specification, the disclosure has been described with reference to specific exemplary embodiments and examples thereof. It will, however, be evident that various modifications and changes may be made thereto without departing from the broader spirit and scope of disclosure as set forth in the claims that follow. The specification and drawings are accordingly to be regarded in an illustrative manner rather than a restrictive sense.

LIST OF REFERENCE NUMERALS

10 rotary vane pump
12 rotor
14 vane
15 vane
16 slot
18 ferrimagnetic material
19 ferrimagnetic material
20 spring
22 variable inductance coil
23 variable inductance coil
24 electric motor
26 measurement unit
30 data record
32 first circuit
34 second circuit
36 stationary support
38 transmitter
40 receiver
42 housing
44 fluid inlet
46 fluid outlet
48 tips
49 tips
50 inner circumferential surface
54 fluid flow chamber
58 first end of fluid flow chamber
60 second end of fluid flow chamber
68 first radial direction
70 second radial direction
72 power source
74 excitation supply
76 transmit coil
78 receive coil
80 first transmit coil
82 second transmit coil
84 first receiver coil
86 second receiver coil
88 microprocessor

What is claimed is:

1. A rotary vane pump comprising:

a rotor configured for being rotated about a center axis;

a vane movably positioned in a radially extending slot formed in the rotor, the vane including a ferrimagnetic material;

an actuator positioned in the slot and configured for moving the vane in the slot, the actuator configured for forcing the vane away from the center axis as the rotor is rotated about the center axis; and a variable inductance coil fixed with the rotor and wrapped around the vane, the vane being movable with respect to the variable inductance coil, an inductance of the variable inductance coil being dependent upon an axial position of the ferrimagnetic material with respect to the variable inductance coil.

2. The rotary vane pump as recited in claim 1 further comprising a measurement unit configured to:

receive signals from the variable inductance coil representing the axial position of the ferrimagnetic material with respect to the variable inductance coil; and determine a rotational position of the rotor as a function of the axial position of the ferrimagnetic material with respect to the variable inductance coil.

3. The rotary vane pump as recited in claim 2 wherein the measurement unit includes a data record associating each of the axial positions of the ferrimagnetic material with respect to the variable inductance coil with at least one rotational position of the rotor.

4. The rotary vane pump as recited in claim 2 wherein the measurement unit includes:

a first circuit on the rotor configured to receive the signals from the variable inductance coil;

a second circuit positioned on a stationary support, the rotor being rotatable with respect to the stationary support;

a transmitter on the rotor electrically connected to the first circuit; and a receiver positioned on the stationary support and electrically connected to the second circuit, the transmitter on the rotor configured to transmit the signals from the variable inductance coil to the receiver, the second circuit configured to receive the position signals from the receiver and to determine a rotational position of the rotor as a function of the position of the ferrimagnetic material with respect to the variable inductance coil.

5. The rotary vane pump as recited in claim 1 further comprising a housing including a fluid inlet and a fluid outlet, the vane configured for a tip of the vane to move along an inner circumferential surface of the housing past the fluid inlet and the fluid outlet as the rotor rotates about the center axis, the actuator configured to force the tip of the vane into the inner circumferential surface of the housing past as the vane rotates about the center axis.

6. The rotary vane pump as recited in claim 5 wherein the inner circumferential surface of the housing has a circular shape when viewed axially, the center axis of the rotor being eccentrically positioned with respect to the circular shape such that the housing and the rotor define a fluid flow chamber having a crescent-shaped cross-section when viewed axially.

7. The rotary vane pump as recited in claim 6 wherein the fluid inlet is at a first end of the crescent-shaped cross-section and the fluid outlet is at a second end of the crescent-shaped cross-section.

8. The rotary vane pump as recited in claim 1 further comprising a further vane movably positioned in the radially extending slot formed in the rotor, the further vane including a ferrimagnetic material;

the actuator positioned in the slot and configured for moving the further vane in the slot, the actuator configured for forcing the further vane away from the center axis as the rotor is rotated about the center axis; and a further variable inductance coil fixed with the rotor and wrapped around the further vane, the further vane being movable with respect to the further variable inductance coil, an inductance of the further variable inductance coil being dependent upon an axial position of the ferrimagnetic material of the further vane with respect to the further variable inductance coil.

9. The rotary vane pump as recited in claim 8 further comprising a housing surrounding the rotor and configure for defining a fluid flow chamber between the housing and the rotor, the actuator configured for forcing a tip of the vane against the housing in a first radial direction and for forcing a tip of the further vane against the housing in a second radial direction opposite of the first radial direction.

10. The rotary vane pump as recited in claim 1 wherein the actuator is a spring.

11. A method of constructing a rotary vane pump comprising:

movably positioning a vane in a radially extending slot formed in a rotor, the vane including a ferrimagnetic material;

positioning an actuator in the slot such that the actuator is configured for moving the vane in the slot to force the vane away from a center axis of the as the rotor is rotated about the center axis; and fixing a variable inductance coil in the rotor wrapped around the vane, the vane being movable with respect to the variable inductance coil, an inductance of the variable inductance coil being dependent upon an axial.

12. The method as recited in claim 11 further comprising providing a housing surrounding the rotor, the housing including a fluid inlet and a fluid outlet, the vane configured for a tip of the vane to move along an inner circumferential surface of the housing past the fluid inlet and the fluid outlet as the rotor rotates about the center axis, the actuator configured to force the tip of the vane into the inner circumferential surface of the housing past as the vane rotates about the center axis.

13. The method recited in claim 12 wherein the inner circumferential surface of the housing has a circular shape when viewed axially, the center axis of the rotor being eccentrically positioned with respect to the circular shape such that the housing and the rotor define a fluid flow chamber having a crescent-shaped cross-section when viewed axially.

14. The method as recited in claim 13 wherein the fluid inlet is at a first end of the crescent-shaped cross-section and the fluid outlet is at a second end of the crescent-shaped cross-section.

15. A method of operating the rotary vane pump as recite in claim 1 comprising:

receiving, by a measurement unit, signals from the variable inductance coil indicating the axial position of the ferrimagnetic material with respect to the variable inductance coil; and determining, by the measurement unit, a rotational position of the rotor as a function of the axial position of the ferrimagnetic material with respect to the variable inductance coil.

16. The method as recited in claim 15, further comprising, recording, by the measurement unit, a data record associating each of the axial positions of the ferrimagnetic material with respect to the variable inductance coil with at least one rotational position of the rotor.

17. The method as recited in claim 15, further comprising:

transmitting, by a transmitter on the rotor, the signals from the variable inductance coil to the receiver;

receiving, by a receiver positioned outside of the rotor, the signals; and determining a rotational position of the rotor as a function of the position of the ferrimagnetic material with respect to the variable inductance coil.

* * * * *